US009262973B2

(12) United States Patent
Wu et al.

(10) Patent No.: US 9,262,973 B2
(45) Date of Patent: Feb. 16, 2016

(54) ELECTROPHORETIC DISPLAY CAPABLE OF REDUCING PASSIVE MATRIX COUPLING EFFECT AND METHOD THEREOF

(71) Applicant: SiPix Technology, Inc., Taoyuan (TW)

(72) Inventors: Yan-Liang Wu, Kaohsiung (TW); Chi-Mao Hung, Hsinchu (TW); Wei-Min Sun, Taipei (TW); Pei-Lin Tien, Taichung (TW); Chih-Yuan Hsu, Taipei (TW); Hsiao-Lung Cheng, Taoyuan County (TW)

(73) Assignee: SiPix Technology, Inc., Kueishan, Taoyuan (TW)

( * ) Notice: Subject to any disclaimer, the term of this patent is extended or adjusted under 35 U.S.C. 154(b) by 13 days.

(21) Appl. No.: 14/172,871

(22) Filed: Feb. 4, 2014

(65) Prior Publication Data

US 2014/0267450 A1 Sep. 18, 2014

(30) Foreign Application Priority Data

Mar. 13, 2013 (TW) ..... 102108825 A

(51) Int. Cl.
*G09G 5/10* (2006.01)
*G09G 3/34* (2006.01)

(52) U.S. Cl.
CPC ..... *G09G 3/344* (2013.01); *G09G 2310/0267* (2013.01)

(58) Field of Classification Search
CPC ..... G02F 1/167; G02F 1/1362; G09G 2300/0486; G09G 3/3648; G09G 3/344; G09G 2300/06; G09G 2310/0267; G09G 2320/0219
See application file for complete search history.

(56) References Cited

U.S. PATENT DOCUMENTS

| | | | | |
|---|---|---|---|---|
| 8,432,355 | B2 | 4/2013 | Johnson | |
| 2005/0057191 | A1* | 3/2005 | Jo et al. | 315/291 |
| 2006/0286703 | A1 | 12/2006 | Um | |
| 2008/0204435 | A1 | 8/2008 | Miyamoto | |
| 2008/0239225 | A1 | 10/2008 | Chen | |
| 2008/0277279 | A1 | 11/2008 | Hirayama | |
| 2008/0297676 | A1* | 12/2008 | Kimura | 349/39 |
| 2009/0066636 | A1* | 3/2009 | Kim et al. | 345/107 |
| 2010/0200278 | A1* | 8/2010 | Wang et al. | 174/254 |
| 2014/0078104 | A1* | 3/2014 | Lee et al. | 345/174 |

FOREIGN PATENT DOCUMENTS

| | | | |
|---|---|---|---|
| CN | 101231825 | A | 7/2008 |
| CN | 101256743 | A | 9/2008 |

(Continued)

*Primary Examiner* — Abbas Abdulselam
*Assistant Examiner* — Gerald Oliver
(74) *Attorney, Agent, or Firm* — Winston Hsu; Scott Margo

(57) ABSTRACT

An electrophoretic display capable of reducing passive matrix coupling effect includes an electrophoretic panel, a plurality of first scan lines, and a plurality of second scan lines. The electrophoretic panel includes a plurality of pixels. Each pixel of the plurality of pixels corresponds to a storage capacitor, and the storage capacitor is coupled to a first scan line and a second scan line. When the pixel is used for displaying a first color, the first scan line receives a first driving voltage, the second scan line is coupled to ground, and other first scan lines and other second scan lines receive a first voltage. A voltage difference between the first driving voltage and the first voltage and a voltage difference between the ground and the first voltage are smaller than a first threshold value corresponding to the first color.

12 Claims, 6 Drawing Sheets

(56) References Cited

FOREIGN PATENT DOCUMENTS

| | | | |
|---|---|---|---|
| CN | 101288113 | A | 10/2008 |
| CN | 101364381 | A | 2/2009 |
| CN | 101425251 | A | 5/2009 |
| TW | 200426746 | | 12/2004 |
| TW | 200834494 | | 8/2008 |
| TW | I301257 | | 9/2008 |
| TW | 201117169 | | 5/2011 |
| TW | 201120847 | | 6/2011 |

* cited by examiner

ELECTROPHORETIC DISPLAY CAPABLE OF REDUCING PASSIVE MATRIX COUPLING EFFECT AND METHOD THEREOF

BACKGROUND OF THE INVENTION

1. Field of the Invention

The present invention relates to an electrophoretic display capable of reducing passive matrix coupling effect and a method thereof, and particularly to an electrophoretic display capable of reducing passive matrix coupling effect and a method thereof that can reduce capacitor coupling effect of a plurality of pixels of the electrophoretic panel to make the plurality of pixels of the electrophoretic panel display correct color.

2. Description of the Prior Art

In the prior art, when a pixel (P) of a passive matrix panel (e.g. an electrophoretic panel) is driven to display a first color (e.g. black color), a first scan line coupled to the pixel (P) is used for receiving a first driving voltage (e.g. 7V), a second scan line coupled to the pixel (P) is used for receiving a second driving voltage (e.g. 0V), and other first scan lines and other second scan lines of the passive matrix panel are floating, where the first scan line coupled to the pixel (P) is located on a first axis direction of the passive matrix panel, the second scan line coupled to the pixel (P) coupled to pixel (P) is located on a second axis direction of the passive matrix panel, and the first axis direction is perpendicular to the second axis direction. Therefore, the pixel (P) can display the first color according to a voltage difference (7V-0V) between the first driving voltage and the second driving voltage, and each pixel of other pixels of the passive matrix panel displays a previous displayed color.

However, when the pixel (P) is driven to display the first color, other pixels of the passive matrix panel are not turned off, so the first driving voltage for driving the pixel (P) may be coupled to other pixels of the passive matrix panel through corresponding parasitic capacitors, resulting in each of other pixels of the passive matrix panel displaying a color not wanted by a user (e.g. black color, white color, or neither black color nor white color). Therefore, the prior art is not a good driving method for the passive matrix panel.

SUMMARY OF THE INVENTION

An embodiment provides an electrophoretic display capable of reducing passive matrix coupling effect. The electrophoretic display includes an electrophoretic panel, a plurality of first scan lines, and a plurality of second scan lines. The electrophoretic panel includes a plurality of pixels. Each pixel of the plurality of pixels corresponds to a storage capacitor, and the storage capacitor is coupled to a first scan line and a second scan line. When the pixel is used for displaying a first color, the first scan line receives a first driving voltage, the second scan line is coupled to ground, and other first scan lines and other second scan lines receive a first voltage. A voltage difference between the first driving voltage and the first voltage and a voltage difference between the first voltage and the ground are smaller than a first threshold value corresponding to the first color.

Another embodiment provides a method capable of reducing coupling effect of a passive matrix electrophoretic display, where the electrophoretic display includes an electrophoretic panel, a plurality of first scan lines, and a plurality of second scan lines, and the electrophoretic panel includes a plurality of pixels. The method includes inputting a driving voltage to a first scan line; coupling a second scan line corresponding to the first scan line to ground; inputting a voltage to other first scan lines and other second scan lines; and a pixel corresponding to the first scan line and the second scan line displaying a color according to a voltage difference between the driving voltage and the ground. The voltage difference between the driving voltage and the voltage and a voltage difference between the voltage and the ground are smaller than a threshold value corresponding to the color.

Another embodiment provides a method capable of reducing coupling effect of a passive matrix electrophoretic display, where the electrophoretic display includes an electrophoretic panel, a plurality of first scan lines, and a plurality of second scan lines. The method includes repeatedly inputting a corresponding driving voltage to each first scan line of the plurality of first scan lines a plurality of times in turn during a refresh frame time of the electrophoretic panel.

The present invention provides an electrophoretic display capable of reducing passive matrix coupling effect and a method thereof. The electrophoretic display and the method make a voltage difference received by a driven pixel is greater than a threshold value corresponding to a color displayed by the driven pixel, and make a voltage difference received by other pixels of the electrophoretic panel is smaller than the threshold value corresponding to the color displayed by the driven pixel, or make a corresponding driving voltage be repeatedly inputted to each first scan line of the plurality of first scan lines a plurality of times in turn during a refresh frame time of the electrophoretic panel. Thus, compared to the prior art, the present invention can reduce capacitor coupling effect of a plurality of pixels of the electrophoretic panel to make the plurality of pixels of the electrophoretic panel display correct colors.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
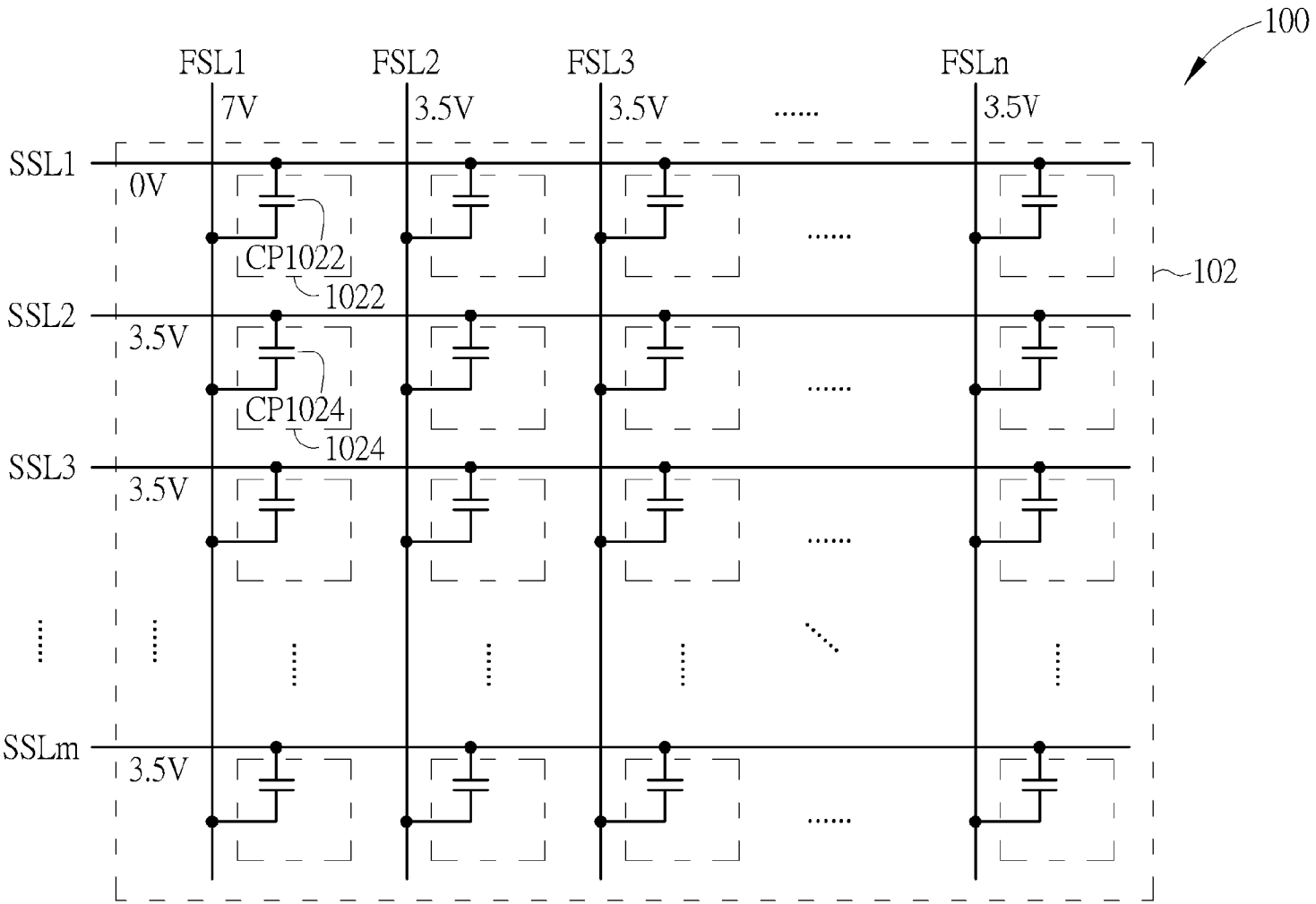
FIG. 1 is a diagram illustrating an electrophoretic display capable of reducing passive matrix coupling effect according to an embodiment.

Please refer to FIG. 1. FIG. 1 is a diagram illustrating an electrophoretic display 100 capable of reducing passive matrix coupling effect according to an embodiment. As shown in FIG. 1, the electrophoretic display 100 includes an electrophoretic panel 102, a plurality of first scan lines FSL1-FSLn, and a plurality of second scan lines SSL1-FSLm, where n, m are integers. As shown in FIG. 1, the electrophoretic panel 102 has a first axis direction (e.g. a vertical direction) and a second axis direction (e.g. a horizontal direction), where the plurality of first scan lines FSL1-FSLn are installed on the first axis direction, and the plurality of second scan lines SSL1-FSLm are installed on the second axis direction. The electrophoretic panel 102 includes a plurality of pixels. Each pixel of the plurality of pixels of the electrophoretic panel 102 corresponds to a storage capacitor, and the storage capacitor is coupled to a first scan line of the plurality of first scan lines FSL1-FSLn and a second scan line of the plurality of second scan lines SSL1-FSLm. For example, a pixel 1022 corresponds to a storage capacitor CP1022, and the storage capacitor CP1022 is coupled to the first scan line FSL1 and the second scan line SSL1; and a pixel 1024 corresponds to a storage capacitor CP1024, and the storage capacitor CP1024 is coupled to the first scan line FSL1 and the second scan line SSL2.

Figure 2:
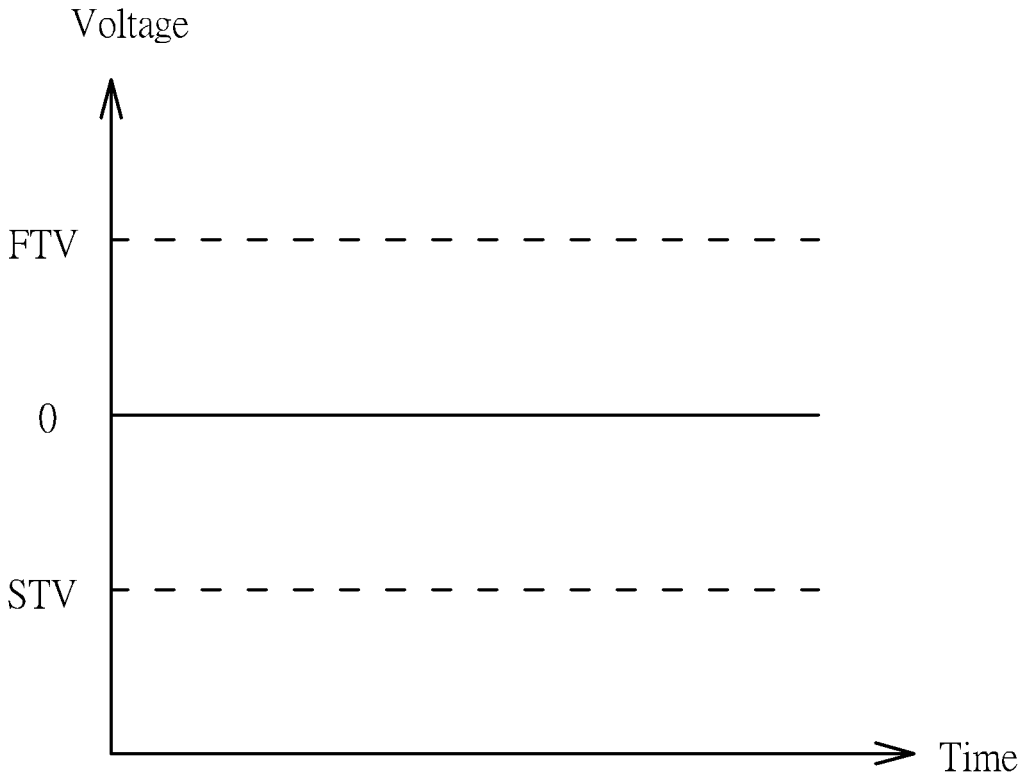
FIG. 2 is a diagram illustrating a first threshold value corresponding to a first color and a second threshold value corresponding to a second color.

Please refer to FIG. 2. FIG. 2 is a diagram illustrating a first threshold value FTV corresponding to a first color and a second threshold value STV corresponding to a second color. As shown in FIG. 1 and FIG. 2, when the pixel 1022 is used for displaying the first color (e.g. black color), the first scan line FSL1 receives a first driving voltage (e.g. 7V), the second scan line SSL1 is coupled to ground (that is, 0V), and other first scan lines of the plurality of first scan lines FSL1-FSLn and other second scan lines of the plurality of second scan lines SSL1-FSLm receive a first voltage (e.g. 3.5V). Because a voltage difference (7V-0V) between the first driving voltage and the ground is greater than the first threshold value FTV (e.g. 4.5V) corresponding to the first color, the pixel 1022 can display the first color according to the voltage difference (7V-0V) between the first driving voltage and the ground, where the first threshold value FTV is used for overcoming frictional force of particles of the pixel 1022 corresponding to the first color. In addition, because other first scan lines of the plurality of first scan lines FSL1-FSLn and other second scan lines of the plurality of second scan lines SSL1-FSLm receive the first voltage, a voltage difference (7V-3.5V) between the first driving voltage and the first voltage and a voltage difference (3.5V-0V) between the first voltage and the ground are smaller than the first threshold value FTV (e.g. 4.5V) corresponding to the first color. Therefore, when other pixels of the electrophoretic panel 102 generate capacitor coupling effect, the voltage difference between the first driving voltage and the first voltage and the voltage difference between the first voltage and the ground are still not sufficient to drive each pixel of other pixels of the electrophoretic panel 102 to change a previous displayed color to display the first color.

In addition, as shown in FIG. 1 and FIG. 2, when the pixel 1022 is used for displaying a second color (e.g. white color), the first scan line FSL1 receives a second driving voltage (e.g. −6V), the second scan line SSL1 is coupled to the ground (that is, 0V), and other first scan lines of the plurality of first scan lines FSL1-FSLn and other second scan lines of the plurality of second scan lines SSL1-FSLm receive a second voltage (e.g. −3V). Because a voltage difference (0V-(−6V)) between the second driving voltage and the ground is greater than an absolute value (e.g. 4V) of the second threshold value STV corresponding to the second color, the pixel 1022 can display the second color according to the voltage difference (0V-(−6V)) between the second driving voltage and the ground, where the second threshold value STV is used for overcoming frictional force of particles of the pixel 1022 corresponding to the second color. In addition, because other first scan lines of the plurality of first scan lines FSL1-FSLn and other second scan lines of the plurality of second scan lines SSL1-FSLm receive the second voltage, a voltage difference (−3V-(−6V)) between the second driving voltage and the second voltage and a voltage difference (0V-(−3V)) between the second voltage and the ground are smaller than the absolute value (e.g. 4V) of the second threshold value STV corresponding to the second color. Therefore, when other pixels of the electrophoretic panel 102 generate capacitor coupling effect, the voltage difference (−3V-(−6V)) between the second driving voltage and the second voltage and the voltage difference (0V-(−3V)) between the second voltage and the ground are still not sufficient to drive each pixel of other pixels of the electrophoretic panel 102 to change a previous displayed color to display the second color.

Figure 3:
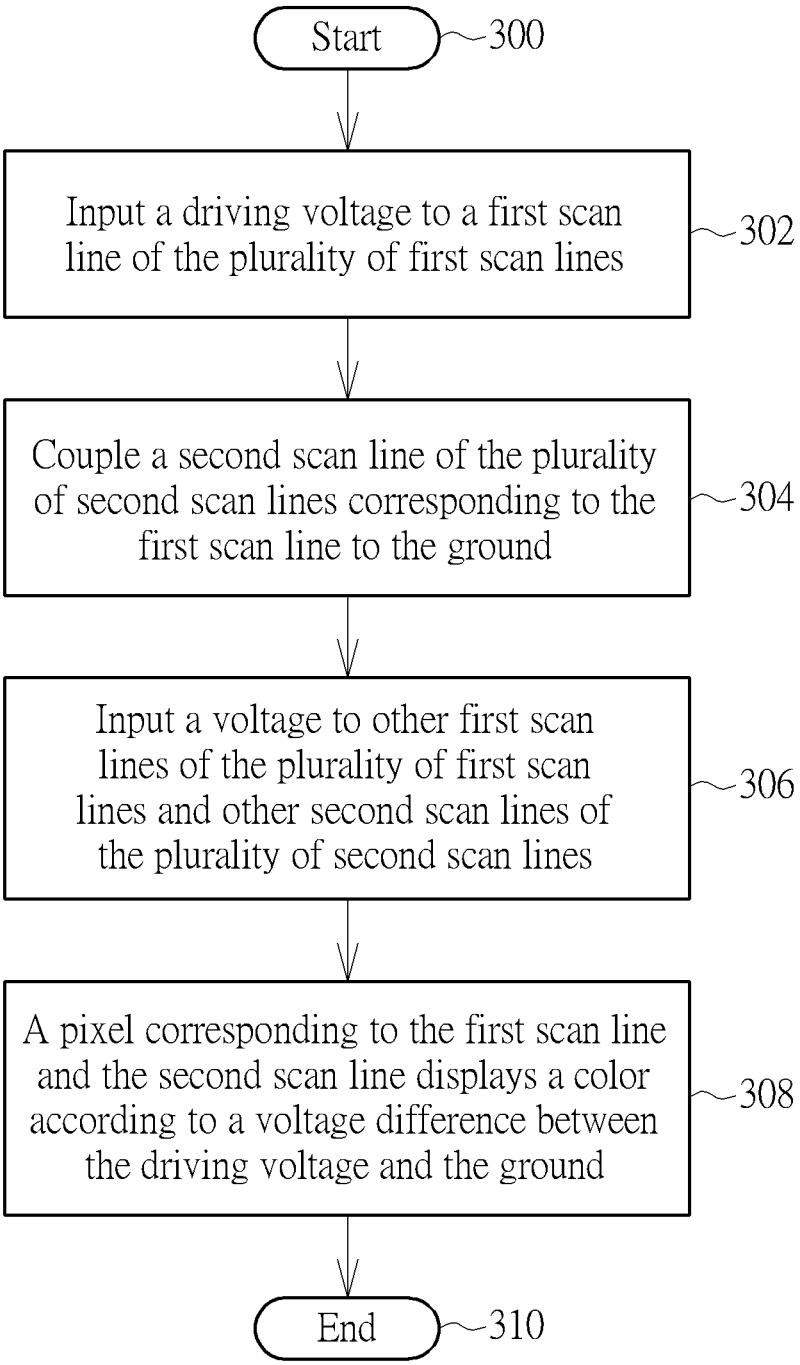
FIG. 3 is a flowchart illustrating a method capable of reducing coupling effect of a passive matrix electrophoretic display according to another embodiment.

Please refer to FIG. 1, FIG. 2, and FIG. 3. FIG. 3 is a flowchart illustrating a method capable of reducing coupling effect of a passive matrix electrophoretic display according to another embodiment. The method in FIG. 3 is illustrated using the electrophoretic display 100 in FIG. 1. Detailed steps are as follows:

Step 300: Start.

Step 302: Input a driving voltage to a first scan line of the plurality of first scan lines FSL1-FSLn.

Step 304: Couple a second scan line of the plurality of second scan lines SSL1-FSLm corresponding to the first scan line to the ground.

Step 306: Input a voltage to other first scan lines of the plurality of first scan lines FSL1-FSLn and other second scan lines of the plurality of second scan lines SSL1-FSLm.

Step 308: A pixel corresponding to the first scan line and the second scan line displays a color according to a voltage difference between the driving voltage and the ground.

Step 310: End.

As shown in FIG. 1 and FIG. 2, in Step 302, Step 304, and Step 306, when the pixel 1022 is used for displaying a first color (e.g. black color), a first driving voltage (e.g. 7V) is inputted to the first scan line FSL1, the second scan line SSL1 is coupled to the ground (that is, 0V), and a first voltage (e.g. 3.5V) is inputted to other first scan lines of the plurality of first scan lines FSL1-FSLn and other second scan lines of the plurality of second scan lines SSL1-FSLm. In Step 308, because a voltage difference (7V-0V) between the first driving voltage and the ground is greater than the first threshold value FTV (e.g. 4.5V) corresponding to the first color, the pixel 1022 can display the first color according to the voltage difference (7V-0V) between the first driving voltage and the ground. In addition, because other first scan lines of the plurality of first scan lines FSL1-FSLn and other second scan lines of the plurality of second scan lines SSL1-FSLm receive the first voltage, a voltage difference (7V-3.5V) between the first driving voltage and the first voltage and a voltage difference (3.5V-0V) between the first voltage and the ground are smaller than the first threshold value FTV (e.g. 4.5V) corresponding to the first color. Therefore, when other pixels of the electrophoretic panel 102 generate capacitor coupling effect, the voltage difference (7V-3.5V) between the first driving voltage and the first voltage and the voltage difference (3.5V-0V) between the first voltage and the ground are still not sufficient to drive each pixel of other pixels of the electrophoretic panel 102 to change a previous displayed color to display the first color.

In addition, as shown in FIG. 1 and FIG. 2, in Step 302, Step 304, and Step 306, when the pixel 1022 is used for displaying a second color (e.g. white color), the first scan line FSL1 receives a second driving voltage (e.g. −6V), the second scan line SSL1 is coupled to the ground (that is, 0V), and other first scan lines of the plurality of first scan lines FSL1-FSLn and other second scan lines of the plurality of second scan lines SSL1-FSLm receive a second voltage (e.g. −3V). In Step 308, because a voltage difference (0V-(−6V)) between the second driving voltage and the ground is greater than the absolute value (e.g. 4V) of the second threshold value STV corresponding to the second color, the pixel 1022 can display the second color according to the voltage difference (0V-(−6V)) between the second driving voltage and the ground. In addition, because other first scan lines of the plurality of first scan lines FSL1-FSLn and other second scan lines of the plurality of second scan lines SSL1-FSLm receive the second voltage, a voltage difference (−3V-(−6V)) between the second driving voltage and the second voltage and a voltage difference (0V-(−3V)) between the second voltage and the ground are smaller than the absolute value (e.g. 4V) of the second threshold value STV corresponding to the second color. Therefore, when other pixels of the electrophoretic panel 102 generate capacitor coupling effect, the voltage difference (−3V-(−6V)) between the second driving voltage and the second voltage and the voltage difference (0V-(−3V)) between the second voltage and the ground are still not sufficient to drive each pixel of other pixels of the electrophoretic panel 102 to change a previous displayed color to display the second color.

Figure 4:
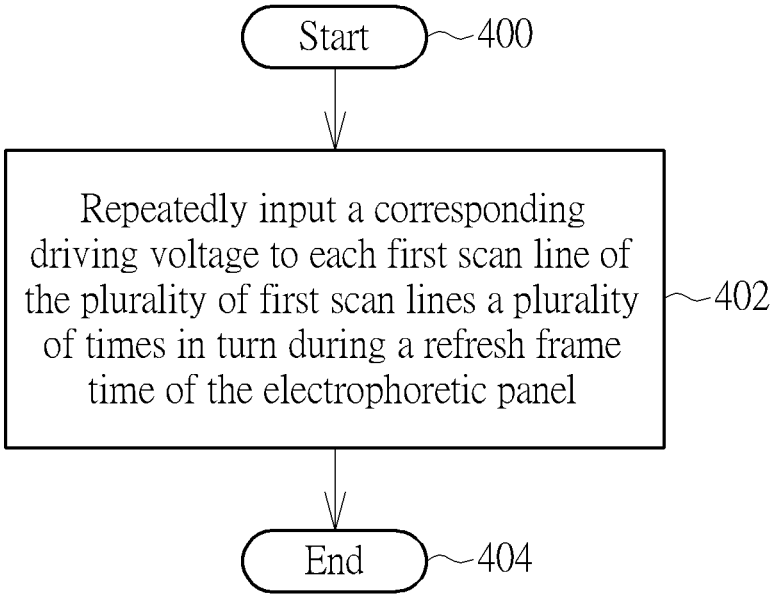
FIG. 4 is a flowchart illustrating a method capable of reducing coupling effect of a passive matrix electrophoretic display according to another embodiment.

Please refer to FIG. 1 and FIG. 4. FIG. 4 is a flowchart illustrating a method capable of reducing coupling effect of a passive matrix electrophoretic display according to another embodiment. The method in FIG. 4 is illustrated using the electrophoretic display 100 in FIG. 1. Detailed steps are as follows:

Step 400: Start.

Step 402: Repeatedly input a corresponding driving voltage to each first scan line of the plurality of first scan lines FSL1-FSLn a plurality of times in turn during a refresh frame time of the electrophoretic panel 102.

Step 404: End.

Figure 5:
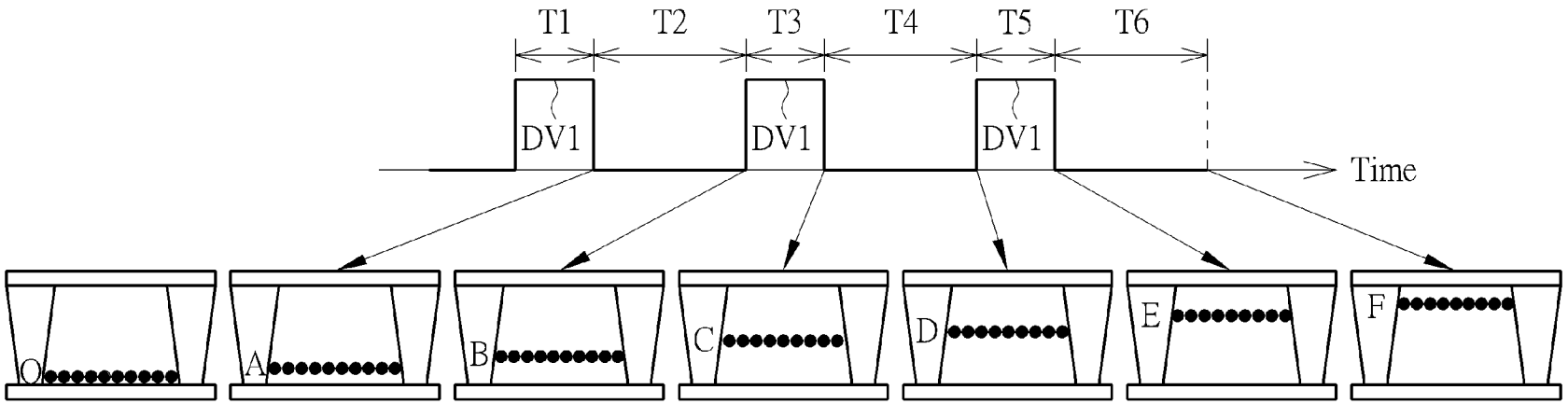
FIG. 5 is a diagram illustrating location of particles of a pixel of the electrophoretic panel when the corresponding driving voltage is repeatedly inputted to each first scan line of the plurality of first scan lines a plurality of time in turn during a refresh frame time of the electrophoretic panel.
Figure 6:
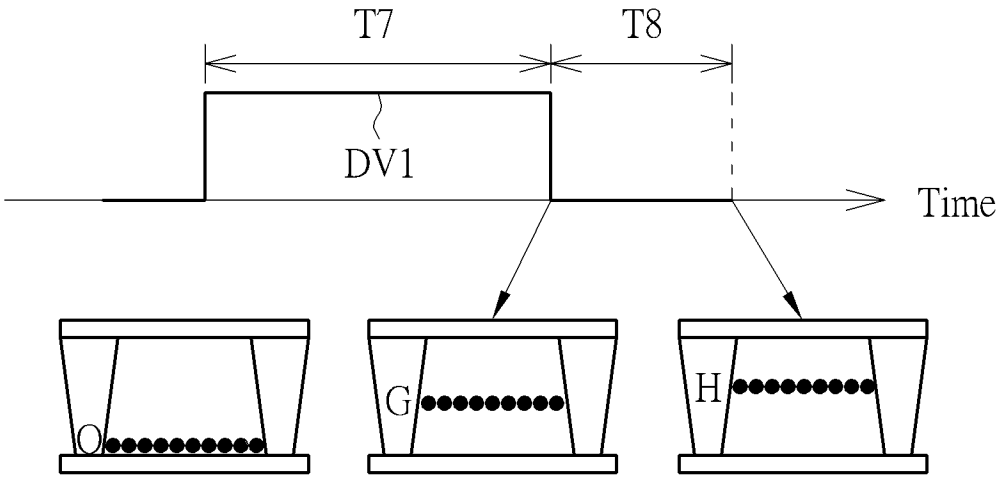
FIG. 6 is a diagram illustrating location of particles of a pixel of the electrophoretic panel when the corresponding driving voltage is inputted to each first scan line of the plurality of first scan lines one time in turn during a refresh frame time of the electrophoretic panel according to the prior art.

As shown in FIG. 1, in Step 402, during a refresh frame time of the electrophoretic panel 102, the corresponding driving voltage is repeatedly inputted to each first scan line of the plurality of first scan lines FSL1-FSLn a plurality of times (e.g. three times) in turn, where when the corresponding driving voltage is inputted to each first scan line, a second scan line corresponding to the first scan line is coupled to the ground, and other first scan lines of the plurality of first scan lines FSL1-FSLn and other second scan lines of the plurality of second scan lines SSL1-FSLm are floating. That is to say, in the prior art, each first scan line of the plurality of first scan lines FSL1-FSLn is only driven by the corresponding driving voltage one time during a refresh frame time of the electrophoretic panel 102. But, in the embodiment in FIG. 4, each first scan line of the plurality of first scan lines FSL1-FSLn is driven by the corresponding driving voltage a plurality of times (e.g. three times). Please refer to FIG. 5 and FIG. 6. FIG. 5 is a diagram illustrating location of particles of a pixel of the electrophoretic panel 102 when the corresponding driving voltage is repeatedly inputted to each first scan line of the plurality of first scan lines FSL1-FSLn a plurality of time in turn during a refresh frame time of the electrophoretic panel 102, and FIG. 6 is a diagram illustrating location of particles of a pixel of the electrophoretic panel 102 when the corresponding driving voltage is inputted to each first scan line of the plurality of first scan lines FSL1-FSLn one time in turn during a refresh frame time of the electrophoretic panel 102 according to the prior art. As shown in FIG. 5, take the pixel 1022 as an example. When a corresponding driving voltage DV1 is inputted to the first scan line FSL1 first time (at a period T1), particles of the pixel 1022 are driven to move from an initial position O to a position A by a voltage difference between the driving voltage DV1 and the ground. At a period T2, after the driving voltage DV1 is disabled, the particles of the pixel 1022 can still move from the position A to a position B due to moving inertia thereof. Similarly, when the corresponding driving voltage DV1 is inputted to the first scan line FSL1 second time (at a period T3), the particles of the pixel 1022 are driven to move from the position B to a position C by the voltage difference between the driving voltage DV1 and the ground. At a period T4, after the driving voltage DV1 is disabled, the particles of the pixel 1022 can still move from the position C to a position D due to the moving inertia. Similarly, when the corresponding driving voltage DV1 is inputted to the first scan line FSL1 third time (at a period T5, the particles of the pixel 1022 are driven to move from the position D to a position E by the voltage difference between the driving voltage DV1 and the ground. At a period T6, after the driving voltage DV1 is disabled, the particles of the pixel 1022 can still move from the position E to a position F due to the moving inertia. In addition, as shown in FIG. 5, a refresh frame time of the electrophoretic panel 102 is equal to a sum of the period T1, the period T3, and the period T5.

As shown in FIG. 6, take the pixel 1022 as an example. When the corresponding driving voltage DV1 is inputted to the first scan line FSL1 at a period T7 (equal to a refresh frame time of the electrophoretic panel 102), the particles of the pixel 1022 are driven to move from the initial position O to a position G by the voltage difference between the driving voltage DV1 and the ground. At a period T8, after the driving voltage DV1 is disabled, the particles of the pixel 1022 can still move from the position G to a position H due to the moving inertia.

As shown in FIG. 5 and FIG. 6, when a corresponding driving voltage is repeatedly inputted to each first scan line of the plurality of first scan lines FSL1-FSLn a plurality of times (e.g. three times) in turn during a refresh frame time of the electrophoretic panel 102, a position of particles of a pixel (e.g. the position F of the particles of the pixel 1022 as shown in FIG. 5) is better than the prior art (e.g. the position H of the particles of the pixel 1022 as shown in FIG. 6), so the embodiment in FIG. 4 can reduce capacitor coupling effect of the electrophoretic panel 102.

Further, in another embodiment of the present invention, in Step 402, the corresponding driving voltage is repeatedly inputted to each first scan line of the plurality of first scan lines FSL1-FSLn a plurality of times (e.g. three times) in turn during a refresh frame time of the electrophoretic panel 102, where when the corresponding driving voltage is inputted to each first scan line, a second scan line corresponding to the first scan line is coupled to the ground, and a voltage is inputted to other first scan lines of the plurality of first scan lines FSL1-FSLn and other second scan lines of the plurality of second scan lines SSL1-FSLm. For example, when a first driving voltage (e.g. 7V) is inputted to the first scan line FSL1, the second scan line SSL1 corresponding to the first scan line FSL1 is coupled to the ground (that is, 0V), and a first voltage (e.g. 3.5V) is inputted to other first scan lines of the plurality of first scan lines FSL1-FSLn and other second scan lines of the plurality of second scan lines SSL1-FSLm, where a voltage difference (7V-3.5V) between the first driving voltage and a first voltage and the voltage difference (3.5V-0V) between the first voltage and the ground are smaller than a threshold value (e.g. 4.5V) corresponding to a color (e.g. black color) displayed by the pixel 1022 of the electrophoretic panel 102. Similarly, when a second driving voltage (e.g. −6V) is inputted to the first scan line FSL1, the second scan line SSL1 corresponding to the first scan line FSL1 is coupled to the ground (that is, 0V), and a second voltage (e.g. −3V) is inputted to other first scan lines of the plurality of first scan lines FSL1-FSLn and other second scan lines of the plurality of second scan lines SSL1-FSLm, where a voltage difference (−3V-(−6V)) between the second driving voltage and the second voltage and a voltage difference (0V-(−3V)) between the second voltage and the ground are smaller than an absolute value (e.g. 4V) of a threshold value corresponding to a color (e.g. white color) displayed by the pixel 1022 of the electrophoretic panel 102.

To sum up, the electrophoretic display capable of reducing passive matrix coupling effect and the method thereof make a voltage difference received by a driven pixel is greater than a threshold value corresponding to a color displayed by the driven pixel, and make a voltage difference received by other pixels of the electrophoretic panel is smaller than the threshold value corresponding to the color displayed by the driven pixel, or make a corresponding driving voltage be repeatedly inputted to each first scan line of the plurality of first scan lines a plurality of times in turn during a refresh frame time of the electrophoretic panel. Thus, compared to the prior art, the present invention can reduce capacitor coupling effect of the plurality of pixels of the electrophoretic panel to make the plurality of pixels of the electrophoretic panel display correct colors.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electrophoretic display capable of reducing passive matrix coupling effect, the electrophoretic display comprising:

an electrophoretic panel comprising a plurality of pixels;

a plurality of first scan lines; and a plurality of second scan lines;

wherein each pixel of the plurality of pixels corresponds to a storage capacitor, and the storage capacitor is coupled to a first scan line of the plurality of first scan lines and a second scan line of the plurality of second scan lines, wherein when the pixel is used for displaying a first color, the first scan line receives a first driving voltage, the second scan line is coupled to ground, and other first scan lines and other second scan lines receive a first voltage, wherein a voltage difference between the first driving voltage and the first voltage and a voltage difference between the first voltage and the ground are smaller than a first threshold value corresponding to the first color.

2. The electrophoretic display of claim 1, wherein when the pixel is used for displaying a second color, the first scan line receives a second driving voltage, the second scan line is coupled to the ground, and other first scan lines and other second scan lines receive a second voltage, wherein a voltage difference between the second driving voltage and the second voltage and a voltage difference between the second voltage and the ground are smaller than a second threshold value corresponding to the second color.

3. The electrophoretic display of claim 2, wherein the first color is a black color and the second color is a white color.

4. The electrophoretic display of claim 1, wherein the electrophoretic panel having a first axis direction and a second axis direction, and the first axis direction is perpendicular to the second axis direction, wherein the plurality of first scan lines are installed on the first axis direction, and the plurality of second scan lines are installed on the second axis direction.

5. A method capable of reducing coupling effect of a passive matrix electrophoretic display, wherein the electrophoretic display comprises an electrophoretic panel, a plurality of first scan lines, and a plurality of second scan lines, and the electrophoretic panel comprises a plurality of pixels, the method comprising:

inputting a driving voltage to a first scan line;

coupling a second scan line corresponding to the first scan line to ground;

inputting a voltage to other first scan lines and other second scan lines; and a pixel corresponding to the first scan line and the second scan line displaying a color according to a voltage difference between the driving voltage and the ground;

wherein the voltage difference between the driving voltage and the voltage and a voltage difference between the voltage and the ground are smaller than a threshold value corresponding to the color.

6. The method of claim 5, wherein the color is a black color.

7. The method of claim 5, wherein the color is a white color.

8. A method capable of reducing coupling effect of a passive matrix electrophoretic display, wherein the electrophoretic display comprises an electrophoretic panel, a plurality of first scan lines, and a plurality of second scan lines, the method comprising:

repeatedly inputting a corresponding driving voltage to each first scan line of the plurality of first scan lines a plurality of times in turn during a refresh frame time of the electrophoretic panel.

9. The method of claim 8, wherein a second scan line corresponding to the first scan line is coupled to ground, and other first scan lines and other second scan lines are floating when the corresponding driving voltage is inputted to the first scan line.

10. The method of claim 8, wherein a second scan line corresponding to the first scan line is coupled to ground, and a voltage is inputted to other first scan lines and other second scan lines when the corresponding driving voltage is inputted to the first scan line, wherein a voltage difference between the corresponding driving voltage and the voltage and a voltage difference between the voltage and the ground are smaller than a threshold value corresponding to a color displayed by a pixel the electrophoretic panel.

11. The method of claim 10, wherein the color is a black color.

12. The method of claim 10, wherein the color is a white color.

* * * * *